US005154460A

United States Patent [19]

Bartsch

[11] Patent Number: 5,154,460

[45] Date of Patent: Oct. 13, 1992

[54] MOTOR VEHICLE DOOR LOCK

[75] Inventor: Jürgen Bartsch, Wuppertal, Fed. Rep. of Germany

[73] Assignee: Bomoro Bocklenberg & Motte GmbH & Co. KG, Wuppertal, Fed. Rep. of Germany

[21] Appl. No.: 623,496

[22] Filed: Dec. 7, 1990

[30] Foreign Application Priority Data

Dec. 11, 1989 [DE] Fed. Rep. of Germany ..... 3940858

[51] Int. Cl.[5] ..... E05C 3/26

[52] U.S. Cl. ..... 292/336.3; 292/DIG. 26; 292/216

[58] Field of Search ..... 292/216, 280, 336.3, 292/DIG. 26

[56] References Cited

U.S. PATENT DOCUMENTS 4,850,625 7/1989 Hori et al. ..... 292/216 X 4,974,886 12/1990 Kleefeldt et al. ..... 292/216 X

FOREIGN PATENT DOCUMENTS 3220705 8/1986 Fed. Rep. of Germany .

*Primary Examiner*—Richard E. Moore

*Attorney, Agent, or Firm*—Sixbey, Friedman, Leedom & Ferguson

[57] ABSTRACT

A motor vehicle door lock with lock latch (30) and detent pawl (31) with a lock mechanism with a base plate (2), an inner release lever (3), an outer release lever (4), an inner safety lever (7), an outer safety lever (8) coupled with inner safety lever (7), and a central lock lever (9) acting on outer safety lever (8) and able to be connected to a central lock drive. The outer safety lever (8) which is stopped in a released position when the lock latch (30) and detent pawl (31) are open, is mechanically optimized, while taking into consideration the requirements of a multistep locking by a central lock by making the stopping of the outer safety lever (8) disengageable, when lock latch (30) and detent pawl (31) are open, by movement of the central lock lever (9) toward a safety position, so that outer safety lever (8) can then be brought with central lock lever (9) into the safety position.

15 Claims, 2 Drawing Sheets

MOTOR VEHICLE DOOR LOCK

BACKGROUND OF THE INVENTION

The invention relates to a motor vehicle door lock with a lock latch and a detent pawl, preferably with a driving journal attached to the detent pawl and used to actuate the detent pawl, with a lock mechanism with a base plate, an inner release lever, an outer release lever, an inner safety lever, an outer safety lever coupled with inner safety lever, a central lock lever acting on the inner safety lever and on the outer safety lever and able to be connected to a central lock drive and, preferably, with a transmission lever and, wherein if a transmission lever is present, the movement of the inner release lever and of the outer release lever is transmitted by the transmission lever to the detent pawl or to a driving journal and, in any case, wherein the outer safety lever and, preferably, also the inner safety lever is or are stopped in the release position when the lock latch and detent pawl are open.

The known motor vehicle door lock on which the invention is based (German-C 3 220 705) has a transmission lever that is mounted, single-armed, to pivot approximately centrally on the outer release lever. The transmission lever has a link slot extending axially approximately along the angle of incidence of the catch pawl, a link slot in which an attachment, bent at a right angle, of the outer safety lever engages as a sliding block. When the outer safety lever, which, moreover, is coupled to move with the inner safety lever by a plug connection, is actuated, the transmission lever is pivoted back and forth, but the linking connection simultaneously makes possible a translational movement of the transmission lever when the outer release lever is actuated. At its exposed end, the transmission lever is provided with an outwardly cleanly cut, slotlike coupling opening whose longitudinal axis also extends in the axial direction of the transmission lever. The cleanly cut area of the coupling opening is delimited by a crossbar projecting crosswise to the angle of incidence and by a lengthwise bar projecting approximately in the angle of incidence, between which a passage is made. If the here-present driving journal of the detent pawl is at the height of the passage, then the transmission lever can be pivoted by the outer safety lever or by the inner safety lever. On the other hand, when the lock latch and detent pawl are open, the driving journal is in the undercut area of the coupling opening. In this case, the transmission lever cannot be pivoted. It thus stops, in this condition, the movement of the outer safety lever and of the inner safety lever, which thus are stopped in this condition in the released position.

With the above-explained design it is achieved that, when the driver's door is open, the driver's door cannot be secured from the inside by locking or by pressing the door button, because otherwise the danger exists that the motor vehicle would become locked with the door key lying in the motor vehicle.

The above-explained motor vehicle door lock also has the possibility of letting a central locking drive engage, with the help of a central lock lever, in the outer safety lever and in the inner safety lever.

With multistep locking, as is increasingly being required in central locks, there arise with the above-explained, known motor vehicle door lock, the problem that the stopping of the outer safety lever and of the inner safety lever, when the lock latch and detent pawl are open, also acts relative to the central lock drive when the latter is activated, for example, by the paasenger door or by the trunk lid, toward the safety position. Here, an electronic memory circuit can be provided that stores the switching command for the central lock drive of the motor vehicle door lock of the door that is still open. This however, is rather expensive and not as reliable as conventional mechanical means.

SUMMARY OF THE INVENTION

Consequently a primary object of the invention is to mechanically configure and further develop the known motor vehicle door lock considering the requirements of a multistep locking by a central lock that has been provided.

The object described above is achieved in a preferred embodiment of a motor vehicle door lock in accordance with the invention by providing means by which the stopping of outer safety lever and of an, optionally, also stopped inner safety lever can be disengaged when the lock latch and detent pawl are open. More specifically, this disengagement is produced by moving the central lock lever toward the safety position, and, during a first part of this displacement, releasing the outer safety lever and, optionally, also the inner safety lever. Then, by completing the displacement, the central lock lever brings the outer safety lever and, optionally, also the inner safety lever together with the central lock lever further into the safety position.

According to the invention, the design of the above-explained electronic solution provided with a memory circuit, with equal treatment of hand actuation and central lock actuation, is being abandoned. Considering and analyzing the requirements of a mechanical solution of the above-explained problem in multistep locks, a differentiation is made between hand actuation, on the one hand, and actuation by the central lock or by the central lock drive, on the other. For hand actuation, prior practice of stopping the outer safety lever, and optionally, also the inner safety lever, when the lock latch and detent pawl are open, is continued. For engagement by the central lock drive, i.e., by the central lock lever, the stopping of the outer safety lever and of the, optionally, also stopped inner safety lever is made disengageable. Thus, it is taken into account that a locking from another point such as, for example, the driver's side of the motor vehicle presupposes that the driver or another operator has the vehicle key in his hand.

In the above explained, known motor vehicle door lock, the stopping of the outer safety lever when the lock latch and detent pawl are open can be overcome by simultaneously pulling the outer release lever when the outer safety lever is actuated. In this way, the transmission lever is translationally moved there in the axial direction so that the driving journal of the detent pawl comes into the area of the passage of the transmission lever. But, then the pivoting movement of the transmission lever, triggered by the outer safety lever, is again possible. This design could also be applied in combination with the teaching of the invention by letting the central lock drive or the central lock lever act on the transmission lever to cause translational movement.

However, in a preferred configuration of the motor vehicle door lock according to the invention, an additional stop lever is provided. More particularly, a stop lever is provided which falls into the stop position between a stop face on the outer safety lever and an opposite face on a stationary part, in particular on a base plate, when the outer safety lever (and optionally the inner safety lever) are in the released position and when lock latch and detent pawl are open. This makes possible a greater design freedom in configuring the lock mechanism.

Further objects, features and advantages of the present invention will become apparent from the following detailed description of the preferred embodiment when considered in conjunction with the accompanying figures of the drawings.

DETAILED DESCRIPTION OF THE PREFERRED EMBODIMENT

First of all, in order to allow for a proper understanding of the drawings, the different views taken are to be explained.

Figure 1:
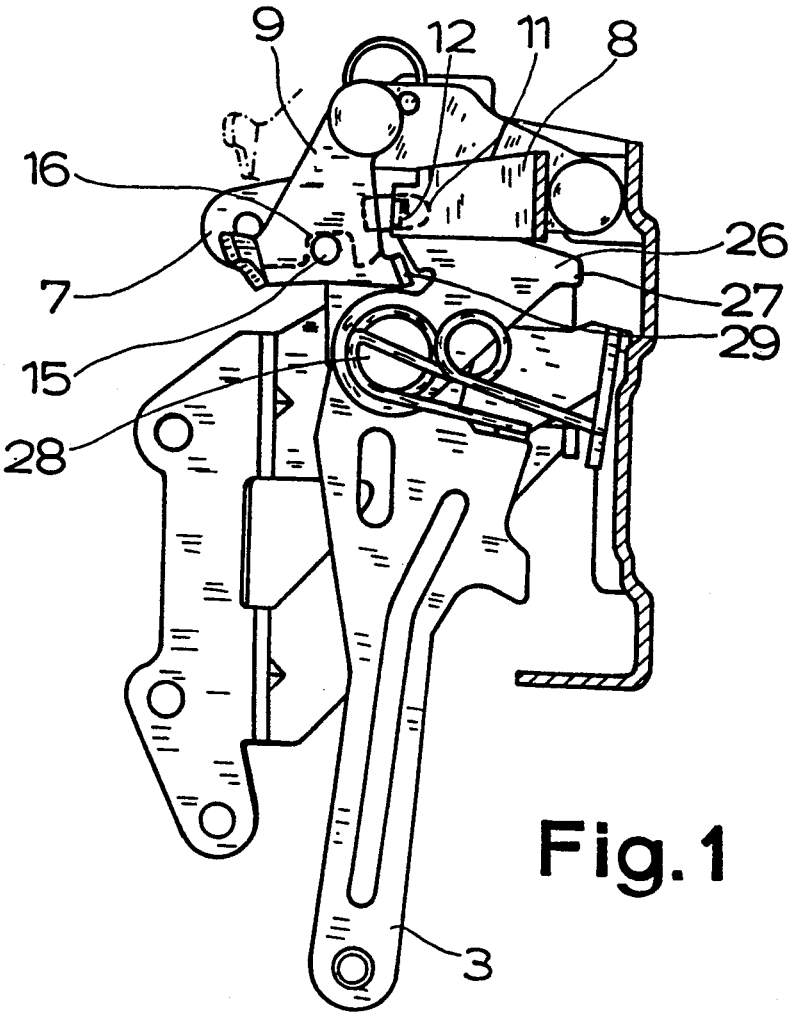
FIG. 1 diagrammatically shows areas of the lock mechanism which are placed at an angle on a base plate of the motor vehicle door lock according to the invention, in a safety position when viewed from the right along section line 1—1 in FIG. 2.
Figure 2:
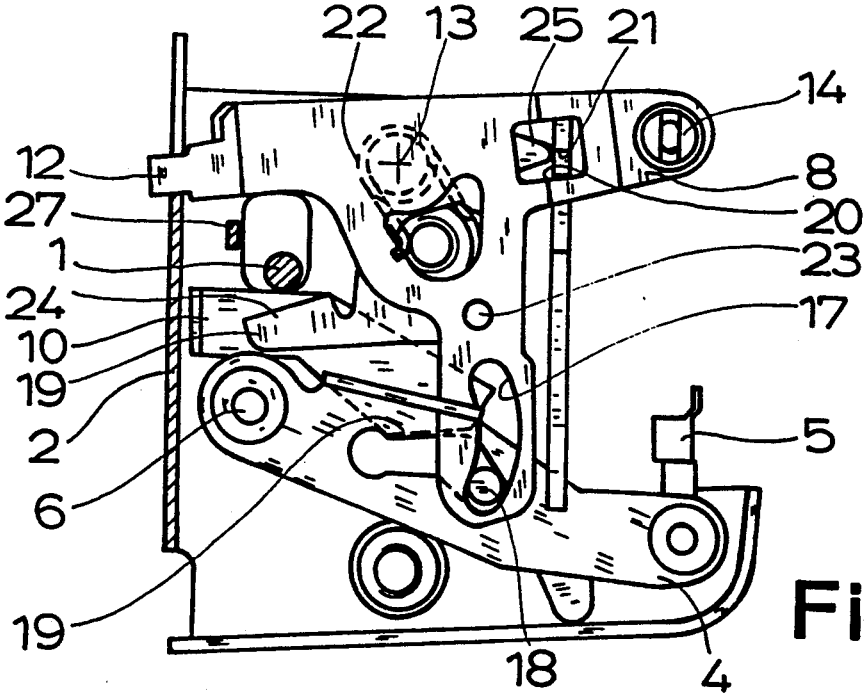
FIG. 2 is a view of the lock mechanism when viewed from the left along section line 2—2 in FIG. 1.
Figure 3:
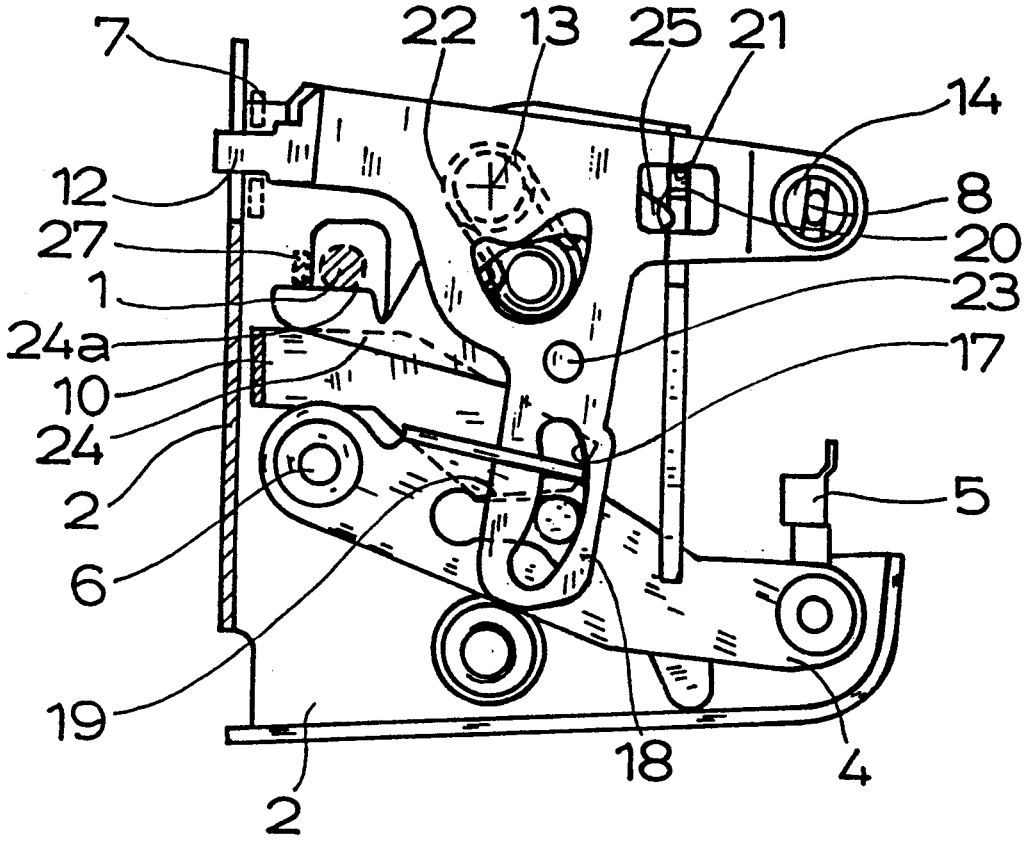
FIG. 3 is a view the same as in FIG. 2, but with the lock in its open position.

In FIG. 2 and FIG. 3 omitted for clarity are the inner release lever 3 as well as the spring shown in FIG. 1 on pivot pin 28.

The motor vehicle door lock represented in the Figures, which must always be considered together, also includes a lock latch 30 and a detent pawl 31, which are indicated in FIG. 1 in dashed lines, and which are conventional in both structure and use. In the represented preferred embodiment, to actuate the detent pawl 31, a driving journal 1 is provided that can be seen in FIG. 2 in its lowest position, where the detent pawl 31 is engaged, i.e., the lock latch 30 is closed. In FIG. 3, the detent pawl 31 in disengaged, i.e. the lock latch 30 is open. The lock mechanism has an angular base plate 2 that forms the support of the entire structure, as well as an inner release lever 3 for releasing the door lock from the inside, and an outer release lever 4 for releasing the door lock from the outside. This can be done, for example, by a rod that engages in a fastening clip 5 of the outer release lever 4 and that can be actuated by an outer lock cylinder to cause outer release lever 4 to be pivoted around a pivot pin 6. The lock mechanism also comprises an inner safety lever 7 (FIG. 1) which is connected to a so-called inner safety button, an outer safety lever 8 that is coupled with inner safety lever 7, and a central lock lever 9 that presses on inner safety lever 7 and on outer safety lever 8, and which will be connected to a central lock drive (not represented) through connecting hook 9*a*. Further, there is an arcuate transmission lever 10, which is journaled on pivot pin 28 shown in FIG. 1.

Inner safety lever 7 has a driving link 11 in which a driving catch 12 of outer safety lever 8 engages. The outer safety lever 8 is journaled on pivot pin 13. On the end of outer safety lever 8 opposite driving catch 12, there is a rod clip 14 for suspension of a rod connected with the lock cylinder of the motor vehicle door lock. The released position of central lock lever 9 is represented in FIG. 1 in dot dash lines. On central lock lever 9 there is fixedly positioned a driving journal 15 which engages in a recess 16 of the inner safety lever 7 to slave it with a small lost motion between them. Because of the coupling of inner safety lever 7 to outer safety lever 8, outer safety lever 8 is also slaved to central lock lever 9.

Outer safety lever 8 is represented, in FIG. 2, as having a T-shape, the lower end of which has an arcuate link slot 17 in which a transmission journal 18 runs. When outer release lever 4 is actuated in the position seen in FIG. 2, transmission journal 18 can be freely swung past the exposed end of the transmission lever 10, thus leaving the movement of outer release lever 4 without any effect. If outer safety lever 8 is pivoted around pivot pin 13 in a clockwise direction, into the released position shown in FIG. 3, then transmission journal 18 comes to lie against a transmission area 19 on transmission lever 10. If, then, outer release lever 4 (or inner release lever 3) is actuated, the transmission lever 10 is pivoted up around its end which is on the left in FIG. 3 and is mounted to pivot around pin 28 on base plate 2, thereby raising driving journal 1 on the detent pawl 31, opening the detent pawl 31 and releasing the latch 30.

Now it is essential that, for the reasons explained in the background portion of this description, outer safety lever 8 and inner safety lever 7, are stopped in the released position when the lock latch 30 and detent pawl 31 are opened. Thus, according to the invention, the outer safety lever 8 is stopped when the lock latch 30 and detent pawl 31 are open. Since the inner safety lever 7 is coupled with outer safety lever 8 through driving link 11 and driving catch 12 the inner safety lever 7 is stopped likewise. The outer safety lever 8 and therewith the inner safety lever 7, however, can be released by moving central lock lever 9 toward the safety position represented in FIG. 1. After being released, outer safety lever 8 and inner safety lever 7 can follow the central lock lever 9 further fully into the safety position.

To stop (and release) the outer safety lever 8 as described above, in the embodiment represented here, an additional stop lever 24 is provided which, when outer safety lever 8 (and here also inner safety lever 7) are in the released position and when the lock latch 30 and detent pawl 31 are open (FIG. 3), falls into a stop position between a stop face 20 on outer safety lever 8 and an opposite face 21 on a stationary part, here on base plate 2. In the embodiment represented here, a spring 22, here in the form of a double leg spring, is provided to bias stop lever 24 towards the stop position between faces 20, 21, as seen in FIG. 3.

Looking at FIG. 2, in the safety position represented, stop catch 25 of stop lever 24 cannot fall into the stop position even though it is mounted to pivot on outer safety lever 8 around pivot pin 23. However, if outer safety lever 8 is pivoted clockwise around pivot pin 13 into the released position (FIG. 3) from the position shown in FIG. 2, then stop lever 24 is also pivoted. When the door is still closed stop lever 24 first comes to lie against driving journal 1 at its contact face 24*a*. This situation is not shown in FIG. 3. Here the spring tension of spring 22 is insufficient to press driving journal 1 with detent pawl 31 upward. If outer release lever 4, for example, is now actuated, then driving journal 1 is raised, and the detent pawl 31 is brought into the open position. Simultaneously contact area 24*a* becomes unblocked and stop lever 24 can pivot further clockwise. Stop catch 25 can now fall in between stop face 20 and opposite face 21 to prevent a backward movement of the outer safety lever 8 (FIG. 3). Simultaneously contact face 24*a* is risen, following pin 1 upwardly.

In order to again release the stopped outer safety lever 8 and inner safety lever 7 with the detent pawl 31 still in its open position, first of all transmission lever 10 itself could be influenced by the central lock drive. In the embodiment represented, however, central lock 9 moves stop lever 24 back into its nonstopping position. This is done specifically by acting upon contact face 24*a* downward from its position in FIG. 3 to its position in FIG. 2. For this purpose, in the embodiment represented, however, no direct coupling of central lock lever 9 and stop lever 24 is provided, but rather another auxiliary lever 26 is placed between them.

Auxiliary lever 26 has an actuation catch 27 that projects into the movement path of contact face 24*a*. This catch 27 is indicated in FIG. 2 and FIG. 3 in dashed lines. If contact face 24*a* of stop lever 24 is in the raised position shown in FIG. 3, then the stop position of stop lever 24 is assumed. A pivoting of auxiliary lever 26 clockwise around pivot pin 28 leads to pressing contact face 24*a* down again, and thus, pivoting stop lever 24 counterclockwise out of its stop position.

The movement of auxiliary lever 26 is achieved by pivoting central lock lever 9 with a corresponding force transmission plate 29 around pivot pin 9*b* on inner safety lever 7, first without any movement of inner safety lever 7. For this purpose, driving journal 15 has sufficient play in recess 16 of inner safety lever 7, as represented in FIG. 1. In the first part of the movement of central lock lever 9 towards the safety position, only auxiliary lever 26 is moved and by means of the transmission plate 29 stop lever 24 is raised out of its stop position so that outer safety lever 8 is released. Further on the way toward the safety position, driving journal 15 comes to lie against the edge of recess 16 on inner safety lever 7 that is visible on the right in FIG. 1 and then begins to slave inner safety lever 7 so that it moves toward the safety position. Because, in the meantime, outer safety lever 8 was released, the pivoting of inner safety lever 7 and of outer safety lever 8 into the safety position can occur without hindrance.

The embodiment represented naturally represents only one form of solution for the basic teaching of the invention, numerous other configuration possibilities are conceivable.

The separate arrangement of an auxiliary lever 26 has the advantage that the installation requirements for an angled configuration of the motor vehicle door lock can be exactly taken into consideration. Auxiliary lever 26, here, is suitably coupled to move with the two levers interacting with it but with each in only one force transmission direction.

What is claimed is:

1. Motor vehicle door lock assembly of the centrally and manually operaable type having a lock latch and detent pawl, a driving journal for actuating of the detent pawl, an inner release lever for manually releasing the door lock assembly from the inside, an outer release lever for manually releasing the door lock assembly from the outside, an inner safety lever and an outer safety lever coupled to the inner safety lever, both of said safety levers being movable between an unlocking position allowing manual unlocking of the door lock assembly and a locking position preventing manual unlocking of the door lock assembly and at least one of said safety levers being in a blocked condition when both of said levers are in the unlocking position and the lock latch and detent pawl are open for preventing manual actuation of the door lock assembly into a locked condition from the inside and from the outside when said lock latch and detent are open, a central lock drive for centrally locking and unlocking the door lock assembly, and a base plate for supporting the entire lock assembly; the improvement for enabling central locking of the door lock assembly when said lock latch and detent pawl are open while enabling the inner and outer safety levers to prevent manual locking of the door lock assembly when said lock latch and detent pawl are open, comprising a central lock lever, said central lock lever being engageable and displaceable by said central lock drive as a means for displacement of said one of the inner and outer safety levers from its blocked condition and thereafter for displacement of both of the safety levers into the locking position condition, despite said lock latch and detent pawl still being open, when said central lock drive is actuated for locking of said door lock assembly.

2. Motor vehicle door lock assembly according to claim 1, wherein a transmission lever is provided, as a means for transmitting movement of the inner release lever and of the outer release lever to one of the detent pawl and driving journal.

3. Motor vehicle door lock according to claim 1, wherein said at least one of the inner and outer safety levers that is in said blocked condition, when the safety levers are in said unlocking condition and the lock latch and detent pawl are open, is the outer safety lever; and wherein a stop lever is provided as a means for producing said blocked condition of the outer safety lever by falling into a stop position, between a stop face on the outer safety lever and an opposite face on a stationary part, when the outer safety lever is in said unlocking position and the lock latch and detent pawl are open.

4. Motor vehicle door lock according to claim 3, wherein said stationary part is said base plate.

5. Motor vehicle door lock according to claim 3, wherein the stop lever is mounted to pivot on the outer safety lever in a manner such that it moves along with movement of the outer safety lever between the unlocking position and the locking position.

6. Motor vehicle door lock according to claim 3, wherein a spring is mounted so as to act on the stop lever in a direction towards the stop position.

7. Motor vehicle door lock according to claim 6, wherein said stop lever is movable by the central lock lever against the action of said spring into said release position that releases the outer safety lever.

8. Motor vehicle door lock according to claim 3, wherein an auxiliary lever is placed between the central lock lever and said stop lever, said auxiliary lever being coupled to move with the central lock lever and said stop lever in only one force transmission direction each.

9. Motor vehicle door lock according to claim 3, wherein said stop lever is mounted for movement by the central lock lever between the stop position and a release position in which said outer safety lever is unblocked.

10. Motor vehicle door lock according to claim 6, wherein an auxiliary lever is located between the central lock lever and said stop lever for moving the stop lever from its stop position into a release position in which the outer safety lever is unblocked, said auxiliary lever being coupled to move with each of the central lock lever and said stop lever in only one force transmission direction.

11. Motor vehicle door lock according to claim 7, wherein an auxiliary lever is located between the central lock lever and said stop lever for moving the stop lever from its stop position into a release position in which the outer safety lever is unblocked, said auxiliary lever being coupled to move with each of the central lock lever and said stop lever in only one force transmission direction.

12. Motor vehicle door lock according to claim 2, wherein the transmission lever is positioned so as to be movable by the central lock lever between a stop position, corresponding to the blocked condition of said at least one of the inner and outer safety levers, and a release position at which said at least one of the inner and outer safety levers unblocked.

13. Motor vehicle door lock according to claim 2, wherein a spring is mounted so as to act on the transmission lever in a direction towards a stop position that corresponds to the blocked condition of said at least one of the inner and outer safety levers.

14. Motor vehicle door lock according to claim 13, wherein the transmission lever is movable by the central lock lever into a release position that releases the outer safety lever against the action of said spring.

15. Motor vehicle door lock according to claim 14, wherein an auxiliary lever is placed between the central lock lever and the transmission lever, said auxiliary lever being coupled to move with the central lock lever and the transmission lever in only one force transmission direction each.

* * * * *